US007857921B2

(12) United States Patent
Busky et al.

(10) Patent No.: US 7,857,921 B2
(45) Date of Patent: Dec. 28, 2010

(54) NONTOXIC, NONCORROSIVE PHOSPHORUS-BASED PRIMER COMPOSITIONS

(75) Inventors: Randall T. Busky, Independence, MO (US); Tod R. Botcher, Grain Valley, MO (US); Joel Sandstrom, Roger, MN (US); Jack Erickson, Andover, MN (US)

(73) Assignee: Alliant Techsystems Inc., Minneapolis, MN (US)

( * ) Notice: Subject to any disclaimer, the term of this patent is extended or adjusted under 35 U.S.C. 154(b) by 986 days.

(21) Appl. No.: 11/367,000

(22) Filed: Mar. 2, 2006

(65) Prior Publication Data

US 2010/0288403 A1 Nov. 18, 2010

(51) Int. Cl.

| | |
|---|---|
| ***C06B 45/00*** | (2006.01) |
| ***C06B 45/18*** | (2006.01) |
| ***C06B 39/00*** | (2006.01) |
| ***C06B 39/06*** | (2006.01) |
| ***C06B 33/00*** | (2006.01) |
| ***C06B 27/00*** | (2006.01) |
| ***D03D 23/00*** | (2006.01) |
| ***D03D 43/00*** | (2006.01) |

(52) U.S. Cl. ..... 149/30; 149/2; 149/3; 149/29; 149/37; 149/87; 149/109.4

(58) Field of Classification Search ..... 149/30, 149/109.4, 2, 3, 29, 37, 87

See application file for complete search history.

(56) References Cited

U.S. PATENT DOCUMENTS

| | | | |
|---|---|---|---|
| 2,194,480 | A | 3/1940 | Pritham et al. |
| 2,231,946 | A | 2/1941 | Rechel et al. |
| 2,649,047 | A | 8/1953 | Silverstein |

(Continued)

FOREIGN PATENT DOCUMENTS

| | | | |
|---|---|---|---|
| EP | 0911366 | A1 | 4/1999 |

(Continued)

OTHER PUBLICATIONS

Eisentrager, Frank; "Key Parameters for the Stability of Red Phosphorous"; 31st International Pyrotechnic Seminar Proceedings, Jul. 2004, Colorado Springs, Colorado, Copyright 2000 © IPSUSA.

(Continued)

*Primary Examiner*—Jerry Lorengo
*Assistant Examiner*—James E McDonough
(74) *Attorney, Agent, or Firm*—Traskbritt

(57) ABSTRACT

A primer composition that includes stabilized, encapsulated red phosphorus, at least one oxidizer, at least one secondary explosive composition, at least one light metal, and at least one acid resistant binder. The stabilized, encapsulated red phosphorus may include particles of red phosphorus, a metal oxide coating, and a polymer layer. The metal oxide coating may be a coating of aluminum hydroxide, bismuth hydroxide, cadmium hydroxide, cerium hydroxide, chromium hydroxide, germanium hydroxide, magnesium hydroxide, manganese hydroxide, niobium hydroxide, silicon hydroxide, tin hydroxide, titanium hydroxide, zinc hydroxide, zirconium hydroxide, or mixtures thereof. The polymer layer may be a layer of epoxy resin, melamine resin, phenol formaldehyde resin, polyurethane resin, or mixtures thereof. A percussion cap primer that includes the primer composition, a tertiary explosive composition, and a cup is also disclosed, as are ordnance devices including the primer composition.

21 Claims, 5 Drawing Sheets

U.S. PATENT DOCUMENTS

| | | | | | |
|---|---|---|---|---|---|
| 2,970,900 | A | * | 2/1961 | Woodring et al. | 149/6 |
| 3,437,534 | A | | 4/1969 | McEwan et al. | |
| 3,488,711 | A | | 1/1970 | Dany et al. | |
| 3,634,153 | A | | 1/1972 | Perkins et al. | |
| 3,650,856 | A | * | 3/1972 | Artz | 149/19.5 |
| 3,726,217 | A | * | 4/1973 | Dedman et al. | 102/202.8 |
| 3,767,488 | A | | 10/1973 | Seals | |
| 3,904,451 | A | | 9/1975 | Rainone | |
| 4,315,897 | A | | 2/1982 | Staendeke et al. | |
| 4,522,665 | A | | 6/1985 | Yates, Jr. et al. | |
| 4,581,082 | A | | 4/1986 | Hagel et al. | |
| 4,698,215 | A | | 10/1987 | Albanesi et al. | |
| 4,728,375 | A | | 3/1988 | Simpson | |
| 4,853,288 | A | | 8/1989 | Staendeke et al. | |
| 4,963,201 | A | | 10/1990 | Bjerke et al. | |
| 5,167,736 | A | | 12/1992 | Mei et al. | |
| 5,216,199 | A | | 6/1993 | Bjerke et al. | |
| 5,388,519 | A | * | 2/1995 | Guindon et al. | 102/292 |
| 5,417,160 | A | | 5/1995 | Mei et al. | |
| 5,522,320 | A | | 6/1996 | Dillehay | |
| 5,567,252 | A | | 10/1996 | Mei et al. | |
| 5,717,159 | A | | 2/1998 | Dixon et al. | |
| 5,831,208 | A | | 11/1998 | Erickson | |
| 6,057,264 | A | * | 5/2000 | Bradbury | 503/227 |
| 6,322,648 | B2 | | 11/2001 | Rayer et al. | |
| 6,478,903 | B1 | | 11/2002 | John, Jr. et al. | |
| 6,581,520 | B1 | | 6/2003 | Koch et al. | |
| 6,612,242 | B2 | | 9/2003 | Raupp et al. | |
| 6,645,625 | B2 | | 11/2003 | Horold et al. | |
| 2002/0127403 | A1 | * | 9/2002 | Horold et al. | 428/403 |
| 2005/0224147 | A1 | | 10/2005 | Jung et al. | |
| 2006/0219341 | A1 | | 10/2006 | Johnston et al. | |

FOREIGN PATENT DOCUMENTS

| | | |
|---|---|---|
| EP | 0 737 174 B1 | 9/2004 |

OTHER PUBLICATIONS

Ratcliff, Andrew; "Review of Six Generations of Red Phosphorous 1950-1999 and Beyond", 27th International Pyrotechnic Seminar Proceedings, Jul. 2000, Grand Junction Colorado, Copyright 2000 © IPSUSA.

Horold, Sebastian and Ratcliff, A.; Commercial Developments in Red Phosphorous Performance and Stablity for Pyrotechnics; Journal of Pyrotechnics, Issue 12, Summer 2001 Copyright © 2001 IPS.

Ratcliff, A.; "Improvements in Stability of Red Phosphorous", 27th International Pyrotechnic Seminar Proceedings, Jul. 2000, Grand Junction Colorado, Copyright © 2000 IPSUSA.

Collins, et al; "The Use of Red Phosphorous in Pyrotechnics—Results of an International Investigation"; 31st International Pyrotechnic Seminar Proceedings, Jul. 2004, Colorado Springs, Colorado, Copyright © 2002, IPSUSA.

European Search Report for European counterpart Application No. EP 07 00 4155, dated Jul. 16, 2007.

Stevenson et al., Frankford Arsenal Report No. R-265; Caliber .30 Red Phosphorus Primers, Third Report Research Item No. 204.0, Frankfort Arsenal Library, Feb. 1943.

Nordblom et al.., Frankfort Arsenal Report No. R-206; The Stabilization of Commercial Red Phosphorus Final Report, Research Item No. 202.14, Frankford Arsenal Library, Apr. 1943.

United States Army, Small Caliber Ammunition Test Procedures 5.56mm Cartridges, Picatinny Aresenal, New Jersey, Nov. 1998, pp. 1-191.

U.S. Appl. No. 12/194,437, filed Aug. 19, 2008, by Randall T. Busky et al., entitled "Nontoxic, Noncorrosive Phosphorus-Based Primer Compositions and an Ordnance Element Including the Same."

Definition of "composition," Hackh's Chemical Dictionary, 4th Ed., Copyright 1969 by McGraw-Hill, Inc., New York, NY.

Definition of "mixture," The American Heritage College Dictionary, 3rd Ed., Copyright 2000 by Houghton Mifflin Company, Boston, MA.

Bosky, Randall, et al., "Non-toxic Heavy Metal Free Primers for Small Arms Cartridges—Red Phosphorous Based," presented May 8, 2007.

Horold, Sebastian; "Improvements in Stability of Red Phosphorous", 27th International Pyrotechnic Seminar Proceedings, Jul. 2000, Grand Junction Colorado, Copyright © 2000 IPSUSA.

Levitas, Valery I., et al., "Mechanochemical mechanism for fast reaction of metastable intermolecular composites based on dispersion of liquid metal," J. Appl. Phys., vol. 101, pp. 083524-1 through 083524-20, 2007.

Railsback, L. Bruce, "An earth scientist's periodic table of the elements and their ions," Geology, pp. 737-740, Sep. 2003.

Railsback, L. Bruce, "An earth scientist's periodic table of the elements and their ions," Version 4.8, University of Georgia, Athens, Georgia, © 2007, http://www.gly.uga.edu/railsback/PT.html.

Rovner, Sophie, "How a Lubricant Additive Works," Chemical & Engineering News, vol. 83, No. 11., p. 10, © 2005.

* cited by examiner

NONTOXIC, NONCORROSIVE PHOSPHORUS-BASED PRIMER COMPOSITIONS

CROSS-REFERENCE TO RELATED APPLICATION

The present application is related to co-pending U.S. patent application Ser. No. 12/194,437, filed Aug. 19, 2008, entitled "NONTOXIC, NONCORROSIVE PHOSPHORUS-BASED PRIMER COMPOSITIONS AND AN ORDNANCE ELEMENT INCLUDING THE SAME."

FIELD OF THE INVENTION

The present invention relates to a nontoxic, noncorrosive primer composition. More specifically, the present invention relates to a primer composition that includes stabilized, encapsulated red phosphorus, an oxidizer, a secondary explosive composition, a light metal, and an acid resistant binder, to percussion cap primers incorporating the primer composition, and to ordnance including the primer composition.

BACKGROUND OF THE INVENTION

A primer composition is a primary explosive composition that is used to initiate or ignite another explosive composition, propellant, or charge. This other explosive composition, propellant, or charge is referred to herein as a tertiary explosive composition. The primer composition is more sensitive to impact and friction than the tertiary explosive composition. The tertiary explosive composition is relatively stable and does not ignite until initiated by the primer composition.

Many ingredients of conventional primer compositions are chronically toxic and their use is regulated by the Environmental Protection Agency. These ingredients include styphnate and picrate salts, heavy metal compounds, or diazodinitrophenol ("DDNP" or dinol). The regulated metal compounds include compounds of mercury, lead, barium, antimony, beryllium, cesium, cadmium, arsenic, chromium, selenium, strontium, or thallium. When combusted, a primer composition that includes one of these ingredients emits toxic lead oxides or toxic compounds of other heavy metals, such as oxides of cesium, barium, antimony, or strontium. DDNP is also hazardous because it is known to cause allergic reactions and is possibly carcinogenic, as identified by The Centers for Disease Control and Prevention/Agency for Toxic Substances and Disease Registry ("CDC"). Some combustion products are gaseous and are inhaled by a user of ordnance when used in applications such as small caliber ammunition that includes the primer composition. Other gaseous combustion products are typically in the form of dust or oxides of the toxic compounds mentioned above. Since small caliber ammunition is fired in large quantities in indoor and outdoor ranges for training or practice, as well as for hunting, sporting events (trap shooting, biathlon, etc.) and military simulations, the user of small caliber ammunition is potentially exposed to large amounts of these toxic combustion products.

To reduce health and environmental risks, primer compositions that are free of lead have been developed. U.S. Pat. No. 4,522,665 to Yates, Jr. et al. discloses a percussion primer that includes titanium and potassium perchlorate. U.S. Pat. No. 5,417,160 to Mei et al. discloses a percussion primer that contains calcium silicide, DDNP, and an alkaline or alkaline earth nitrate. U.S. Pat. No. 5,167,736 to Mei et al. discloses a percussion primer that includes DDNP and boron and U.S. Pat. No. 5,567,252 to Mei et al. discloses a percussion primer that includes DDNP, boron, and iron oxide. U.S. Pat. Nos. 4,963,201 and 5,216,199 to Bjerke et al. disclose a percussion primer that includes DDNP, strontium nitrate, tetracene, and a nitrate ester fuel. U.S. Pat. No. 6,478,903 to John, Jr. et al. discloses a percussion primer that includes bismuth sulfide and potassium nitrate or zinc sulfide and aluminum nitrate. U.S. Pat. No. 4,581,082 to Hagel et al. discloses a primer charge that includes zinc peroxide, DDNP, and/or a strontium salt of mono- and/or dinitrodihydroxydiazobenzene. U.S. Pat. No. 5,831,208 to Erickson discloses a lead-free, center-fire primer that includes barium nitrate, a primary explosive, a sensitizer, a nitrated ester, an abrasive sensitizer, a fuel, and a binder.

Red phosphorus has also been used in primer compositions. Red phosphorus is an allotrope of phosphorus that has a network of tetrahedrally arranged groups of four phosphorus atoms linked into chains. White phosphorous is another allotrope that is much more reactive and toxic than red phosphorous. The two allotropes have such unique physical characteristics that they have different CAS numbers, as registered by the Chemical Abstract Service ("CAS"). U.S. Pat. No. 2,970,900 to Woodring et al. discloses a noncorrosive, priming composition that includes red phosphorus, a secondary explosive, and an oxidizing agent. The red phosphorus is stabilized by treatment with acid, elutriation, and coating with aluminum hydroxide. The secondary explosive is pentaerythritol tetranitrate ("PETN"), trimethylenetrinitramine, trinitrotoluene ("TNT"), or mixtures thereof. The oxidizing agent is barium nitrate, potassium nitrate, lead nitrate, lead dioxide, basic lead nitrate, or a barium nitrate-potassium nitrate double salt. U.S. Pat. No. 2,194,480 to Pritham et al. discloses a noncorrosive, priming composition that includes red phosphorus, a fuel, and an oxidizer, such as red phosphorus, zirconium, barium nitrate, strontium nitrate, basic lead nitrate, lead peroxide, or antimony sulfide. U.S. Pat. No. 2,649,047 to Silverstein discloses a primer that includes a primer composition and a metal cup. The primer composition includes red phosphorus and barium nitrate. The metal cup is formed from a metal or coated with a metal that is less catalytically active than nickel, such as aluminum, aluminum alloys, zinc, chromium, cadmium, lead, tin, lead/tin alloys, or Duralumin. U.S. Pat. No. 2,231,946 to Rechel et al. discloses a propellant powder that includes a small amount of red phosphorus, which inhibits erosion of the gun barrel.

Red phosphorus is relatively stable in air and is easier to handle than other allotropes of phosphorus. However, if red phosphorus is exposed to oxygen ("$O_2$"), water ("$H_2O$"), or mixtures thereof at elevated temperatures, such as during storage, the red phosphorus reacts with the $O_2$ and $H_2O$, releasing phosphine ("$PH_3$") gas and phosphoric acids ($H_3PO_2$, $H_3PO_3$, or $H_3PO_4$). As is well known, the $PH_3$ is toxic and the phosphoric acids are corrosive. To improve the stability of red phosphorus in environments rich in $O_2$ or $H_2O$, dust suppressing agents, stabilizers, or microencapsulating resins have been used. The dust suppressing agents are liquid organic compounds. The stabilizers are typically inorganic salts, such as metal oxides. The microencapsulating resins are thermoset resins, such as epoxy resins or phenolic resins. Currently, microencapsulating resins are not used in military phosphorus applications. The military specification for phosphorous has been deactivated and is not expected to be updated to include encapsulation.

Red phosphorus has also been used as a flame retardant in a polymer-based composition, as disclosed in U.S. Pat. No. 4,698,215 to Albanesi et al. The red phosphorus is stabilized by coating particles of the red phosphorus with a first layer of aluminum hydroxide and a second layer of an ureamelamine-phenol-formaldehyde resin. Red phosphorus has also been used in a pyrotechnic composition to block infrared radiation and visible light, as disclosed in U.S. Pat. No. 4,728,375 to Simpson. The red phosphorus is stabilized by dispersing the red phosphorus in a rubber.

BRIEF SUMMARY OF THE INVENTION

The present invention relates to a primer composition that includes a stabilized, encapsulated red phosphorus, at least one oxidizer, at least one secondary explosive composition, at least one light metal, and at least one acid resistant binder. The stabilized, encapsulated red phosphorus may include particles of red phosphorus, a metal oxide coating, and a polymer layer. The metal oxide coating may be a coating of a metal oxide selected from the group consisting of aluminum hydroxide, bismuth hydroxide, cadmium hydroxide, cerium hydroxide, chromium hydroxide, germanium hydroxide, magnesium hydroxide, manganese hydroxide, niobium hydroxide, silicon hydroxide, tin hydroxide, titanium hydroxide, zinc hydroxide, zirconium hydroxide, and mixtures thereof. The polymer layer may be a layer of epoxy resin, melamine resin, phenol formaldehyde resin, polyurethane resin, or mixtures thereof.

The at least one oxidizer may be a light metal nitrate selected from the group consisting of lithium nitrate, beryllium nitrate, sodium nitrate, magnesium nitrate, potassium nitrate, calcium nitrate, rubidium nitrate, strontium nitrate, cesium nitrate, and mixtures thereof. The at least one secondary explosive composition may be PETN, cyclotrimethylenetrinitramine ("RDX"), cyclotetramethylene tetranitramine ("HMX"), TNT, hexanitrohexaazaisowurtzitane ("CL-20"), or mixtures thereof. The at least one light metal may include, but is not limited to, magnesium, aluminum, or mixtures thereof. The at least one acid resistant binder may be gum arabic, gum tragacanth, styrene-butadine, epoxy resin, isobutylene rubber, gum xanthan, gum turpentine, polyester, polyurethane, polystyrene, or mixtures thereof. In one embodiment, the primer composition may include the stabilized, encapsulated red phosphorus, PETN, potassium nitrate, aluminum, and gum tragacanth.

The present invention also relates to a percussion primer that includes a primer composition and a tertiary explosive composition contained in a cup. The primer composition includes stabilized, encapsulated red phosphorus, at least one oxidizer, at least one secondary explosive composition, at least one light metal, and at least one acid resistant binder. The stabilized, encapsulated red phosphorus comprises particles of red phosphorus, a metal hydroxide coating, and a polymer layer. The ingredients of the primer composition are as described above. The percussion primer may be used in a cartridge for small arms ammunition, a grenade, a mortar fuse, a detcord initiator, a rocket motor, an illuminating flare, a signaling flare, or an aircraft ejection seat.

The present invention also encompasses ordnance including the primer composition of the present invention, including, without limitation, cartridges for small arms ammunition (e.g., rimfire cartridges, center fire cartridges, shot shells, rifled slugs, etc.), grenades, mines, mortar fuses, detcord initiators, rocket motors, illuminating flares, and signaling flares. The present invention also includes other explosive and propellant-based devices, such as aircraft ejection seats, tubular goods cutters, explosive bolts, etc.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1:
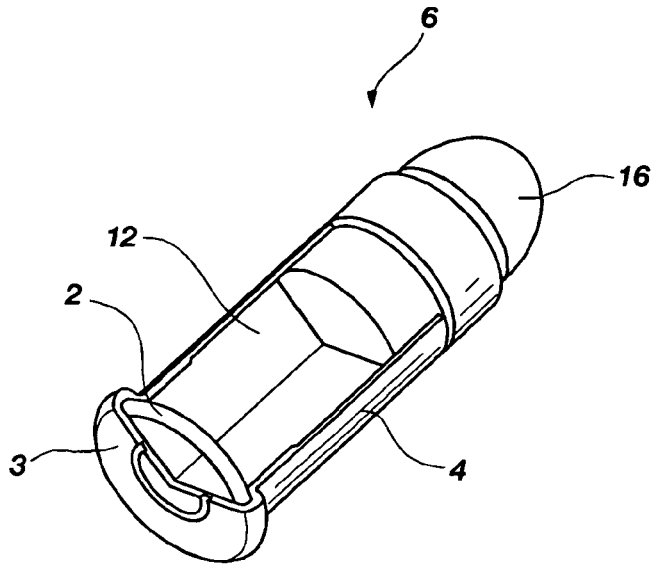
FIG. 1 is a cross-sectional view of a rimfire gun cartridge.

An explosive composition for use as a primer composition is disclosed. The primer composition may initiate or detonate upon impact, heat (spark or flame), friction, slight percussion, such as shock waves, or combinations thereof. Upon initiation, the primer composition generates heat, gases, and condensing hot particles that are of sufficient energy to ignite a tertiary explosive composition in an ordnance device, such term including any device including at least one of an explosive or propellant, including structures configured with warheads or other projectiles. As such, the primer composition is the first explosive composition ignited in an ignition train of the ordnance device. The primer composition may include ingredients that are low in toxicity, free of heavy metals, stable to aging, and noncorrosive. These ingredients may include elements that are biologically available, have a high concentration tolerance, and are active in known cycles in the environment or biosphere. For the sake of example only, these elements may include, but are not limited to, carbon, hydrogen, nitrogen, oxygen, potassium, sodium, calcium, phosphorus, magnesium, aluminum, and tin. When combusted, the primer composition may generate nontoxic and noncorrosive combustion products and by-products. The primer composition may also be highly reliable in that it reliably ignites the secondary explosive composition.

The primer composition includes a stabilized, encapsulated form of red phosphorus, an oxidizer, a secondary explosive composition, a light metal, and a binder. Relative amounts of these ingredients may be adjusted to achieve desired properties of the primer composition upon combustion. As used herein, the term "stabilized, encapsulated" refers to red phosphorus having improved stability to oxidation. For instance, when the stabilized, encapsulated red phosphorus is exposed to an environment that includes $O_2$, $H_2O$, or mixtures thereof, the stabilized, encapsulated red phosphorus does not readily react with the $O_2$ or $H_2O$, in contrast to red phosphorus that lacks stabilization. The stabilized, encapsulated red phosphorus may have an increased useful lifetime in the primer composition compared to red phosphorus that lacks stabilization. The stabilized, encapsulated red phosphorus may be present in a range of from approximately 10% by weight ("wt %") of a total weight of the primer composition to approximately 30 wt % of the total weight of the primer composition.

The red phosphorus may be stabilized by coating particles of the red phosphorus with a metal oxide, such as a metal hydroxide. The metal oxide may be precipitated on a surface of the red phosphorus particles. The metal oxide coating functions as a stabilizer to buffer traces of acids that form upon oxidation of the red phosphorus. The metal oxide may be aluminum hydroxide, bismuth hydroxide, cadmium hydroxide, cerium hydroxide, chromium hydroxide, germanium hydroxide, magnesium hydroxide, manganese hydroxide, niobium hydroxide, silicon hydroxide, tin hydroxide, titanium hydroxide, zinc hydroxide, zirconium hydroxide, or mixtures thereof. The metal oxide may be present in the stabilized, encapsulated red phosphorus in a total quantity that ranges from approximately 0.1 wt % to approximately 2 wt % based on the quantity of red phosphorus.

Once stabilized, the particles of the red phosphorus may be encapsulated by coating the particles with a polymer, such as a thermoset resin. Encapsulating the stabilized, red phosphorus particles reduces their active surface and provides the stabilized, red phosphorus particles with water repellency and acid resistance. Examples of polymers that may be used to encapsulate the stabilized, red phosphorus particles include, but are not limited to, an epoxy resin, melamine resin, phenol formaldehyde resin, polyurethane resin, or mixtures thereof. The polymer may be present in the stabilized, encapsulated red phosphorus in a total quantity that ranges from approximately 1 wt % to approximately 5 wt % based on the quantity of red phosphorus. The metal oxide and the polymer may be present in a total quantity of from approximately 1.1% wt % to approximately 8 wt % based on the quantity of red phosphorus.

The red phosphorus particles may be coated with the metal oxide by mixing an aqueous suspension of the red phosphorus particles with a water-soluble metal salt. The pH of the aqueous suspension may be adjusted, precipitating the metal oxide on the red phosphorus particles. An aqueous solution of a preliminary condensation product of the polymer may be prepared and added, with mixing, to the coated red phosphorus particles. The solution and the coated red phosphorus particles may be reacted for a period of time that ranges from approximately one-half hour to approximately three hours at a temperature ranging from approximately 40° C. to approximately 100° C., enabling the preliminary condensation product to polymerize and harden around the coated red phosphorus particles. The stabilized, encapsulated red phosphorus particles may then be filtered and dried at an elevated temperature, such as at a temperature ranging from approximately 80° C. to approximately 120° C., in a stream of nitrogen. Stabilized, encapsulated red phosphorus is commercially available, such as from Clariant GmbH (Frankfurt, Germany). In one embodiment, the stabilized, encapsulated red phosphorus is Red Phosphorus HB 801 (TP), which is available from Clariant GmbH.

The oxidizer used in the primer composition may be a light metal nitrate. As used herein, the term "light metal nitrate" refers to a nitrated compound of an alkali or alkali earth metal (from Group I or Group II of the Periodic Table of the Elements) having an atomic mass of less than or equal to approximately 133. The oxidizer may include, but is not limited to, lithium nitrate, beryllium nitrate, sodium nitrate, magnesium nitrate, potassium nitrate, calcium nitrate, rubidium nitrate, strontium nitrate, cesium nitrate, or mixtures thereof. If potassium nitrate is used as the oxidizer, the potassium nitrate may be stabilized, such as by encapsulating the potassium nitrate. In one embodiment, the oxidizer is sodium nitrate, potassium nitrate, calcium nitrate, or mixtures thereof. The oxidizer may be present in the primer composition at a range of from approximately 30 wt % of the total weight of the primer composition to approximately 80 wt % of the total weight of the primer composition.

The primer composition may also include a secondary explosive composition, which provides insensitive physical ignition properties to the primer composition. The secondary explosive composition may be a compound or a mixture of compounds that includes carbon, hydrogen, nitrogen, and oxygen. Examples of secondary explosive compositions that may be used include, but are not limited to, PETN, RDX, HMX, TNT, or mixtures thereof. In addition, insensitive nitramine or nitroaromatic compounds may be used, such as CL-20, compounds with properties similar to those of CL-20, or mixtures thereof. The secondary explosive composition may be present in the primer composition at a range of from approximately 1 wt % of the total weight of the primer composition to approximately 10 wt % of the total weight of the primer composition.

The light metal used in the primer composition may be a metal having an atomic mass of less than or equal to approximately 27, such as magnesium, aluminum, or mixtures thereof. The light metal may be present in the primer composition at a range of from approximately 0 wt % of the total weight of the primer composition to approximately 10 wt % of the total weight of the primer composition.

The binder used in the primer composition may be acid resistant. For instance, the binder is resistant to phosphoric acids, which may be generated as phosphorus oxides. The binder may be a compound or a mixture of compounds that includes carbon, hydrogen, nitrogen, and oxygen. For the sake of example only, the binder may be a polymer or rubber compound that is resistant to phosphoric acids, such as gum arabic, gum tragacanth, styrene-butadine, epoxy resin, isobutylene rubber, gum xanthan, gum turpentine, polyester, polyurethane, polystyrene, or mixtures thereof. The binder may be present at a range of from approximately 0 wt % of the total weight of the primer composition to approximately 20 wt % of the total weight of the primer composition.

For the sake of example only, the primer composition may include from approximately 20 wt % to approximately 30 wt % of Red Phosphorus HB 801 (TP), from approximately 0 wt % to approximately 10 wt % of PETN, from approximately 40 wt % to approximately 70 wt % of potassium nitrate, from approximately 0 wt % to approximately 10 wt % of aluminum, and from approximately 0.2 wt % to approximately 1.0 wt % of gum tragacanth.

In one embodiment, the primer composition, when dry, includes approximately 25 wt % Red Phosphorus HB 801 (TP), 5 wt % PETN, 64.8 wt % potassium nitrate, 5 wt % aluminum, and 0.2 wt % gum tragacanth.

The primer composition may be produced by mixing the stabilized, encapsulated red phosphorus, the oxidizer, the secondary explosive composition, the light metal, and the binder with approximately 15% water (by total weight) to form a homogenous mixture. Adding the water may desensitize the mixture to impact, friction, and static electrical ignition. These ingredients may be mixed by conventional techniques, such as those used for producing lead styphnate primer compositions, which are not described in detail herein.

Once produced, the primer composition may be loaded into a percussion cap primer, which is then used in various types of ordnance, such as in a cartridge for small arms ammunition, grenade, mortar fuse, or detcord initiator. The percussion cap includes the primer composition and the tertiary composition, which are contained in a cup. The primer composition may be used to initiate or prime a mortar round, rocket motor, illuminating flare, signaling flare, or ejection seat. For the sake of example only, the primer composition may be used in a small arms cartridge, such as in a centerfire gun cartridge or in a rimfire gun cartridge. The centerfire gun cartridge may be a Boxer primer, a Berdan primer, or a shot shell primer (Milbank type). The percussion cap may be loaded with the primer composition using conventional techniques, such as those used in lead styphnate compositions, which are not described in detail herein.

The tertiary explosive composition used in the ordnance device may be selected by one of ordinary skill in the art and, therefore, is not discussed in detail herein. The tertiary explosive composition may be any explosive composition that is less sensitive to impact than the primer composition, such as a propellant or other charge. For instance, if the ordnance device is a gun cartridge, the tertiary explosive composition may be gun powder. In a grenade, the primer composition may be used to ignite a delay charge. In many cases, such as in mortar rounds or medium artillery cartridges, the primer composition may be used to ignite a booster charge that includes black powder or boron/potassium nitrate with an organic binder.

Figure 2:
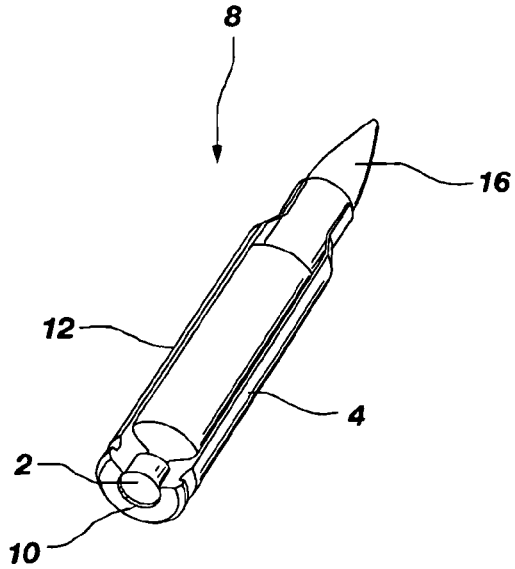
FIG. 2 is a cross-sectional view of a centerfire gun cartridge.

In one embodiment, the primer composition is used in a centerfire gun cartridge, a rimfire gun cartridge, or a shot shell. Rimfire ignition and centerfire ignition differ significantly from one another and, therefore, a primer composition that is suitable for use in the centerfire gun cartridge may not provide optimal performance in the rimfire gun cartridge. Centerfire ignition and shot shell differ slightly from each, since the shot shell configuration has a bar anvil and a battery cup. In small arms using the rimfire gun cartridge, a firing pin strikes a rim of a casing of the gun cartridge. In contrast, the firing pin of small arms using the centerfire gun cartridge strikes a metal cup in the center of the cartridge casing containing the primer composition. Gun cartridges and cartridge casings are known in the art and, therefore, are not discussed in detail herein. The force or impact of the firing pin may produce an impact event or a percussive event that is sufficient to ignite the primer composition in the rimfire gun cartridge or in the centerfire gun cartridge, causing the tertiary explosive composition to ignite or detonate. For instance, the impact of the firing pin may generate heat, flames, and hot particles, which ignite the tertiary explosive composition, causing a detonation. As shown in FIG. 1, the primer composition 2 may be substantially evenly distributed around an interior volume defined by a rim portion 3 of a casing 4 of the rimfire gun cartridge 6. The primer composition 2 may be positioned in an aperture 10 in the casing 4, as shown in FIG. 2, which is a centerfire gun cartridge 8. The tertiary explosive composition 12 may be positioned substantially adjacent to the primer composition 2 in the rimfire gun cartridge 6 or in the centerfire gun cartridge 8. When ignited or combusted, the primer composition 2 may produce sufficient heat and condensing hot particles to ignite the tertiary explosive composition 12 to propel projectile 16 from the barrel of the firearm or larger caliber ordnance (such as, without limitation, handgun, rifle, automatic rifle, machine gun, automatic cannon, etc.) in which the cartridge 6 or 8 is disposed.

Figure 3:
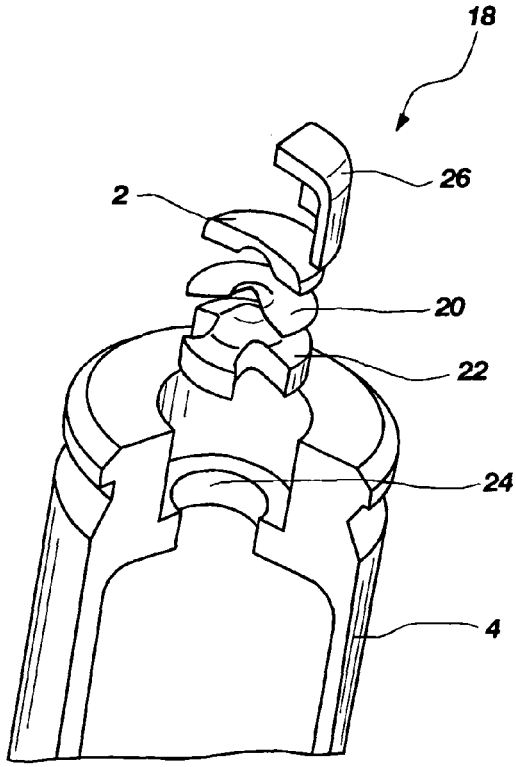
FIG. 3 is a cross-sectional view of a Boxer-type primer.
Figure 4:
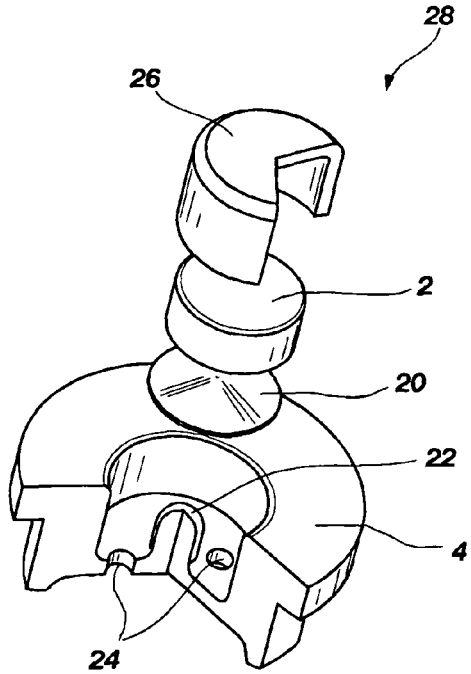
FIG. 4 is a cross-sectional view of a Berdan-type primer.
Figure 5:
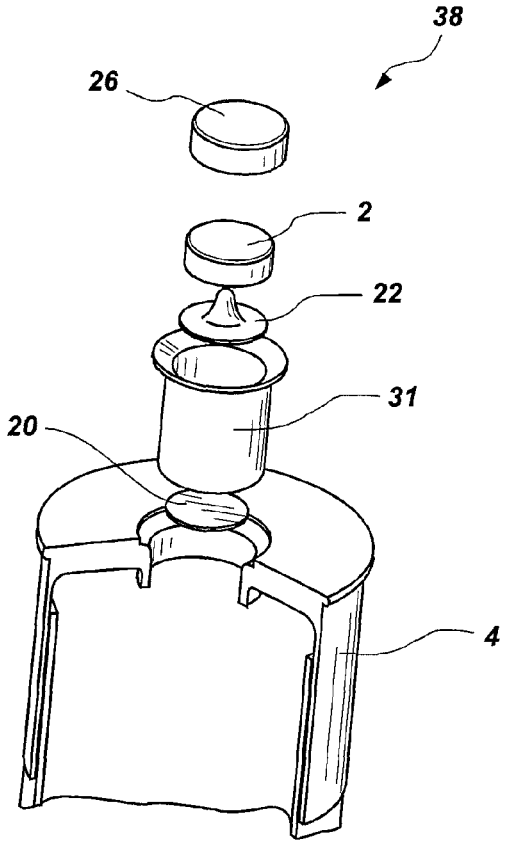
FIG. 5 is a cross-sectional view of a shot shell primer (Milbank type)

In another embodiment, the primer composition 2 may be used in a Boxer primer 18, as shown in FIG. 3. The Boxer primer 18 may include the primer composition 2 deposited in a primer cup or percussion cap 26. The Boxer primer 18 also includes a primer foil 20 in communication with the primer composition 2 and an anvil 22 pressed into the percussion cap 26. The percussion cap 26 may be positioned with a casing 4 such that at least a portion of the percussion cap 26 and the contents thereof may be positioned over a flash hole 24 in the center of the casing 4. In another embodiment, the primer composition 2 may be used in a Berdan primer 28, as shown in FIG. 4. The Berdan primer 28 may include the primer composition 2 deposited in a primer cup or percussion cap 26. A primer foil 20 may be placed between the primer composition 2 and an anvil 22 integrated with a casing 4. The percussion cap 26, with the primer composition 2 and primer foil 20 may be positioned over an anvil 22 in a casing 4 and over flash holes 24 in the casing 4. In another embodiment, the primer composition 2 may be used in a shot shell primer 38, as shown in FIG. 5. The shot shell primer 38 may include the primer composition 2 and an anvil 22 positioned in a battery cup 31 with a percussion cap 26 placed over the primer composition 2 in the battery cup 31. A primer foil 20 may be positioned between the battery cup 31 and a casing 4.

Figure 6:
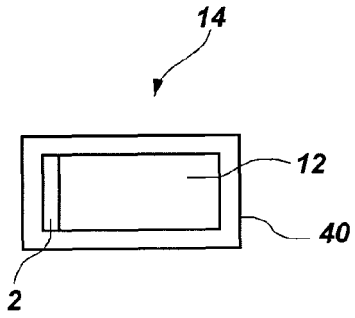
FIG. 6 is a schematic illustration of an exemplary ordnance device in which a primer composition of the present invention is used.

As previously mentioned, the percussion primer having the primer composition 2 may be used in larger ordnance, such as (without limitation) grenades, mortar rounds, mines and detcord initiators, or to initiate, rocket motors, illuminating and signal flares, as well as in ejection seats, tubular goods cutters, explosive bolts and other systems including another explosive composition or charge, alone or in combination with a propellant. In an ordnance device 14, the primer composition 2 may be positioned substantially adjacent to the tertiary explosive composition 12 in a housing 40, as shown in FIG. 6. In the instance of an ordnance device 14 including a propellant (not shown), the tertiary explosive composition 12 may typically be used to initiate the propellant.

Upon combustion, the primer composition may produce environmentally friendly or recyclable combustion products and by-products, which are absorbed by, or dispersed into, the biosphere or environment. Alternatively, the combustion products and by-products may be tolerated by the biosphere in high concentrations or may be dispersed quickly throughout the food chain. The combustion products and by-products include, but are not limited to, phosphorus oxides (such as PO, $PO_2$, $P_2O_3$, $P_2O_4$, or $P_2O_5$), metal phosphates, carbon dioxide, small amounts of phosphoric acids (such as $H_3PO_2$, $H_3PO_3$, or $H_3PO_4$), small amounts of $PH_3$, or mixtures thereof. NASA Lewis Chemical Thermodynamic Code was used to model or predict the combustion products, which are shown in Table 1, at 1000 psi, 10,000 psi, and 50,000 psi.

TABLE 1

Predicted Chemical Species Produced upon Combustion.

| Chemical Species | 1,000 psi (%) | 10,000 psi (%) | 50,000 psi (%) |
|---|---|---|---|
| P | 0 | 0.001 | 0.001 |
| PH | 0 | 0 | 0 |
| $PH_3$ | 0 | 0 | 0 |
| PN | 0.009 | 0.167 | 0.268 |
| PO | 0.532 | 1.730 | 1.593 |
| $PO_2$ | 23.958 | 17.556 | 13.414 |
| $P_2$ | 0 | 0.001 | 0.004 |

TABLE 1-continued

Predicted Chemical Species Produced upon Combustion.

| Chemical Species | 1,000 psi (%) | 10,000 psi (%) | 50,000 psi (%) |
|---|---|---|---|
| $P_4O_6$ | 36.256 | 37.856 | 41.060 |
| $P_4O_{10}$ | 0 | 0 | 0 |
| K | 17.657 | 9.361 | 5.702 |
| KCN | 0 | 0 | 0 |
| KH | 0.004 | 0.029 | 0.012 |
| KO | 2.018 | 1.350 | 1.649 |
| KOH | 13.576 | 12.767 | 3.483 |
| $K_2$ | 0.723 | 1.814 | 3.525 |
| KOH (L) | 0 | 0 | 9.544 |
| $K_2CO_3$ (L) | 5.267 | 17.368 | 19.745 |

Figure 7:
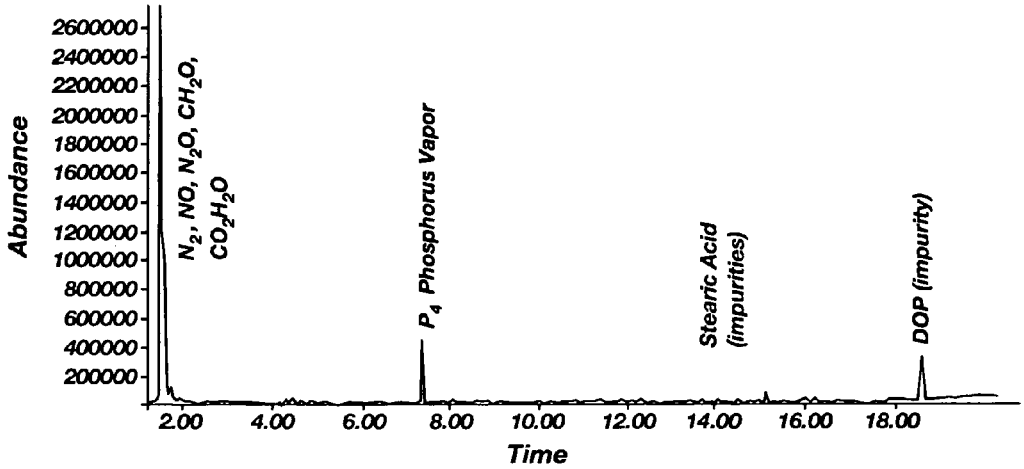
FIG. 7 is a total ion gas chromatogram from a closed bomb test using the primer composition of the present invention.

Closed bomb gas chromatograph analysis was used to confirm the presence of most of the chemical species predicted as combustion products, as shown in FIG. 7.

The phosphorus-based combustion products and by-products may react with $O_2$, $H_2O$, or mixtures thereof in the biosphere to form phosphates, which are biodegradable. Phosphates are present in manure, soil, rocks, fertilizer, detergents, water, and plants and are more environmentally friendly than combustion products of conventional primer compositions, such as lead-based primer compositions. In addition, since elemental phosphorus is an essential mineral and is utilized in the Kreb's Cycle to convert pyruvate to carbon dioxide, the phosphorus-based combustion products and by-products produced from the primer composition are regulated by the body's biosynthesis mechanisms. In contrast, the combustion by-products of lead-based primer compositions are generally accumulated by the body's organs.

By stabilizing and encapsulating the red phosphorus and by including a binder in the primer composition, the primer composition may generate reduced amounts of $PH_3$ and phosphoric acids during storage. This reduction in corrosive by-products enables the primer composition to be used in conventional, brass percussion cups. In addition, the primer composition may be more stable than conventional lead-based or lead-free primer compositions when exposed to $O_2$, $H_2O$, or mixtures thereof at elevated temperatures. However, when combusted, the primer composition may achieve similar performance characteristics and properties as a conventional lead-based primer composition, a conventional lead-free primer composition, or a conventional phosphorous-based primer composition.

The stabilized, encapsulated red phosphorus in the primer composition may also prevent corrosion and wear of a barrel of the gun in which the primer composition is initiated. The small amount of phosphoric acids that is produced upon combustion of the stabilized, encapsulated red phosphorus may produce wear-resistant and corrosion-resistant compounds that deposit on a surface of the barrel. These compounds may provide a self-replenishing, protective layer on the barrel, improving the life of the barrel.

The following examples serve to explain embodiments of the primer composition in more detail. These examples are not to be construed as being exhaustive or exclusive as to the scope of this invention.

EXAMPLES

Example 1

Primer Composition Including Stabilized, Encapsulated Red Phosphorus

A primer composition having approximately 25 wt % Red Phosphorus HB 801 (TP), 5 wt % PETN, 64.8 wt % potassium nitrate, 5 wt % aluminum, and 0.2 wt % gum tragacanth was formulated by mixing the ingredients with 15% water. The primer composition was mixed by conventional techniques. The primer composition is referred to herein as the "stabilized, encapsulated red phosphorus-based primer" and is indicated in the figures as "P4 Primer" or "RP."

Example 2

Stability of the Stabilized, Encapsulated Red Phosphorus-Based Primer

Stability of the primer composition described in Example 1 was tested by exposing the stabilized, encapsulated red phosphorus-based primer to a constant elevated temperature (approximately 50° C.) without humidity regulation. The stabilized, encapsulated red phosphorus-based primer was impact tested in accordance with Military Specification Mil P 44610 at all the fire heights. The stabilized, encapsulated red phosphorus-based primer was found to have a 0% misfire failure rate after approximately 180 days at the elevated temperature. In contrast, a lead styphnate-based primer known as Federal K75 had a 99% misfire failure rate after approximately 55 days at the same, elevated temperature.

Example 3

Impact Sensitivity of the Stabilized, Encapsulated Red Phosphorus-Based Primer Impact sensitivity of the primer composition described in Example 1 and the lead styphnate-based primer described in Example 2 were determined according to Military Specification Mil P 44610.

The stabilized, encapsulated red phosphorus-based primer had an average drop height of 6.7 inches (standard deviation of 1.2) and the lead styphnate-based primer had an average drop height of 7.4 inches (standard deviation of 1.1). Since the stabilized, encapsulated red phosphorus-based primer and the lead styphnate-based primer had statistically similar impact sensitivities, no change in configuration of the stabilized, encapsulated red phosphorus-based primer in a percussion cap was necessary.

Example 4

Performance of the Stabilized, Encapsulated Red Phosphorus-Based Primer

Figure 8:
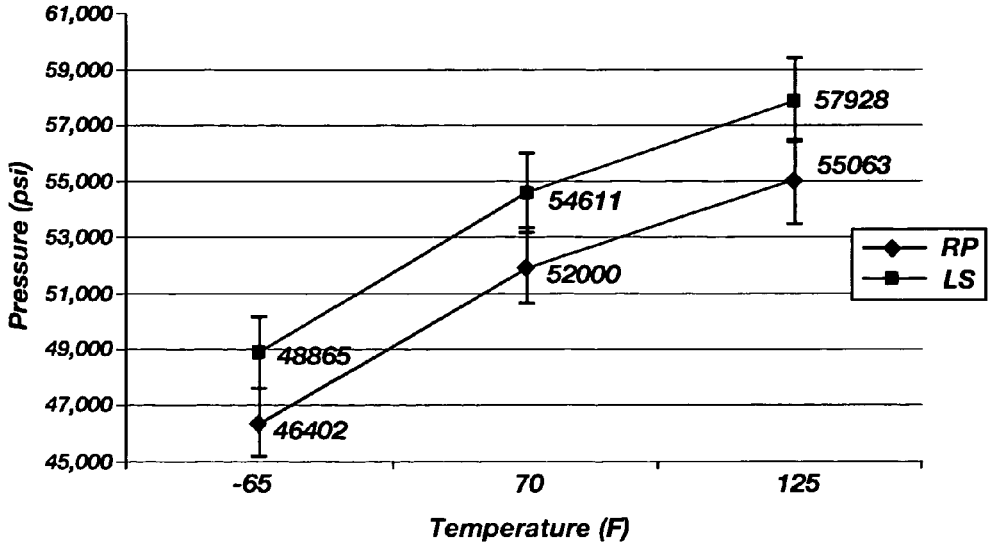
FIG. 8 shows the cartridge firing temperature versus gun chamber pressure of the primer composition of the present invention compared to that of a lead styphnate-based primer composition with a conventional propellant charge.
Figure 9:
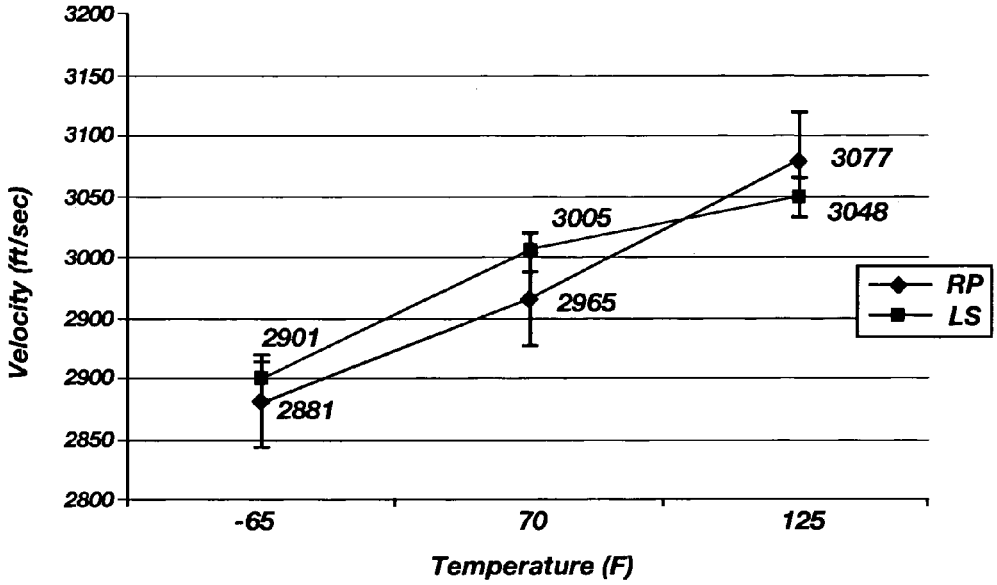
FIG. 9 shows the cartridge firing temperature versus muzzle velocity of the primer composition of the present invention compared to that of a lead styphnate-based primer composition with a conventional propellant charge.

The stabilized, encapsulated red phosphorus-based primer and the lead styphnate-based primer described above were loaded into conventional cartridges. The cartridge firing temperature versus propellant chamber pressure of the stabilized, encapsulated red phosphorus-based primer and the lead styphnate-based primer was determined for approximately 27 grain charge weight according to Government Specification Small Caliber Ammunition Test Procedure ("SCAT-P") 5.56 mm, Section 18. The lead styphnate-based primer is indicated in FIGS. 8 and 9 as "LP." As shown in FIG. 8, the firing temperature versus propellant chamber pressure of the cartridges including the stabilized, encapsulated red phosphorus-based primer was demonstrated to provide equal or less pressure at all firing temperatures, especially at cold temperatures. In contrast, cold temperature firing pressures using other non-toxic primer compositions have been shown to have undesirably high chamber pressures.

The cartridge firing temperature versus muzzle velocity of the stabilized, encapsulated red phosphorus-based primer and the lead styphnate-based primer in the conventional cartridge was determined according to SCAT-P, Section 20. As shown in FIG. 9, the firing temperature versus muzzle velocity of the stabilized, encapsulated red phosphorus-based primed cartridges was approximately equal to that of the lead styphnate-based primed cartridges. As shown by FIGS. 7-9 and Table 2, the stabilized, encapsulated red phosphorus-based primed cartridges and the lead styphnate-based primed cartridges had similar cartridge impact sensitivities, velocities, and pressures. Acceptable impact sensitivity limits may be determined by measuring height and voltage readings of a primer misfire and then comparing the H/V+/−3S values, where H is a height measurement, V is a voltage measurement and S is the standard deviation of the test results multiplied by the interval of the tests. Acceptable impact sensitivities are indicated by H/V+3S values of less than 12.0 and H/V−3S values of greater than 3.0. The data in Table 2 indicate that acceptable impact sensitivities were obtained for embodiments of the invention.

TABLE 2

| | |
|---|---|
| Pi * m (m is the interval of the test) | 2.20 |
| H/V + (m/2) | 4.50 |
| H or V | 6.70 |
| H/V + (3) S | 10.3000 |
| H/V − (3) S | 3.1000 |

However, the stabilized, encapsulated red phosphorus-based primer had a greater long-term thermal stability than the lead styphnate-based primer.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A primer composition comprising a homogeneous mixture of 25% by weight of a stabilized, encapsulated red phosphorus, 64.8% by weight of potassium nitrate, 5% by weight of pentaerythritol tetranitrate, 5% by weight of aluminum, and 0.2% by weight of gum tragacanth.

2. The primer composition of claim 1, wherein the stabilized, encapsulated red phosphorus comprises red phosphorus, a metal oxide coating, and a polymer layer.

3. The primer composition of claim 2, wherein the metal oxide coating comprises a coating of a metal oxide selected from the group consisting of aluminum hydroxide, bismuth hydroxide, cadmium hydroxide, cerium hydroxide, chromium hydroxide, germanium hydroxide, magnesium hydroxide, manganese hydroxide, niobium hydroxide, silicon hydroxide, tin hydroxide, titanium hydroxide, zinc hydroxide, zirconium hydroxide, and mixtures thereof.

4. The primer composition of claim 2, wherein the polymer layer comprises a layer of epoxy resin, melamine resin, phenol formaldehyde resin, polyurethane resin, or mixtures thereof.

5. A primer composition comprising a homogeneous mixture of red phosphorus stabilized with a metal oxide and encapsulated with a polymer, at least one oxidizer, at least one secondary explosive composition, and at least one light metal, the red phosphorus comprising from approximately 10% by weight to 28% by weight of a total weight of the primer composition, the at least one oxidizer comprising from approximately 30% by weight to approximately 80% by weight of the total weight of the primer composition, the at least one secondary explosive composition comprising from approximately 1% by weight to approximately 10% by weight of the total weight of the primer composition, and the at least one light metal comprising from approximately 5% by weight to approximately 10% by weight of the total weight of the primer composition.

6. The primer composition of claim 5, wherein the at least one oxidizer comprises a light metal nitrate selected from the group consisting of lithium nitrate, beryllium nitrate, sodium nitrate, magnesium nitrate, potassium nitrate, calcium nitrate, rubidium nitrate, strontium nitrate, cesium nitrate, and mixtures thereof.

7. The primer composition of claim 5, wherein the at least one secondary explosive composition comprises pentaerythritol tetranitrate, cyclotrimethylenetrinitramine, cyclotetramethylene tetranitramine, trinitrotoluene, hexanitrohexaazaisowurtzitane, or mixtures thereof.

8. The primer composition of claim 5, wherein the at least one light metal comprises magnesium, aluminum, or mixtures thereof.

9. The primer composition of claim 5, wherein the primer composition comprises particles of red phosphorus, a coating of the metal oxide on the particles of red phosphorus, and an encapsulation layer of the polymer on the particles of red phosphorus.

10. A primer composition comprising a homogeneous mixture of stabilized, encapsulated red phosphorus, at least one oxidizer, at least one light metal, and at least one secondary explosive composition, the stabilized, encapsulated red phosphorus comprising from approximately 10% by weight to 28% by weight of a total weight of the primer composition, the at least one oxidizer comprising from approximately 40% by weight to approximately 70% by weight of the total weight of the primer composition, the at least one light metal comprising from approximately 1% by weight to approximately 10% by weight of the total weight of the primer composition, and the at least one secondary explosive composition comprising from approximately 1% by weight to approximately 10% by weight of the total weight of the primer composition.

11. The primer composition of claim 10, wherein the stabilized, encapsulated red phosphorus comprises red phosphorus, a metal oxide, and a polymer, wherein the metal oxide comprises a coating of a metal hydroxide selected from the group consisting of aluminum hydroxide, bismuth hydroxide, cadmium hydroxide, cerium hydroxide, chromium hydroxide, germanium hydroxide, magnesium hydroxide, manganese hydroxide, niobium hydroxide, silicon hydroxide, tin hydroxide, titanium hydroxide, zinc hydroxide, zirconium hydroxide, and mixtures thereof, and wherein the polymer comprises a layer of epoxy resin, melamine resin, phenol formaldehyde resin, polyurethane resin, or mixtures thereof.

12. The primer composition of claim 10, further comprising at least one binder.

13. The primer composition of claim 12, wherein the at least one binder comprises from approximately 0.2% by weight to approximately 20% by weight of the total weight of the primer composition.

14. The primer composition of claim 12, wherein the primer composition comprises a homogeneous mixture of stabilized, encapsulated red phosphorus, pentaerythritol tetranitrate, potassium nitrate, aluminum, and gum tragacanth.

15. The primer composition of claim 12, wherein the primer composition consists essentially of a homogeneous mixture of stabilized, encapsulated red phosphorus, potassium nitrate, pentaerythritol tetranitrate, aluminum, and gum tragacanth.

16. The primer composition of claim 10, wherein the stabilized, encapsulated red phosphorus comprises red phosphorus, a metal oxide precipitated on a surface of the red phosphorus, and a polymer encapsulating the red phosphorus.

17. The primer composition of claim 10, wherein the at least one light metal comprises magnesium, aluminum, or mixtures thereof.

18. The primer composition of claim 12, wherein the stabilized, encapsulated red phosphorus comprises 25% by weight of the total weight of the primer composition, potassium nitrate comprises 64.8% by weight of the total weight of the primer composition, pentaerythritol tetranitrate comprises 5% by weight of the total weight of the primer composition, aluminum comprises 5% by weight of the total weight of the primer composition, and gum tragacanth comprises 0.2% by weight of the total weight of the primer composition.

19. A primer composition comprising a homogeneous mixture of stabilized, encapsulated red phosphorus, at least one oxidizer, at least one light metal, and at least one binder, the stabilized, encapsulated red phosphorus comprising from approximately 10% by weight to 28% by weight of a total weight of the primer composition, the at least one oxidizer comprising from approximately 40% by weight to approximately 70% by weight of the total weight of the primer composition, the at least one light metal comprising from approximately 1% by weight to approximately 10% by weight of the total weight of the primer composition, and the at least one binder comprising from approximately 0.2% by weight to approximately 1.0% by weight of the total weight of the primer composition.

20. The primer composition of claim 19, wherein the at least one binder comprises gum arabic, gum tragacanth, gum xanthan, gum turpentine, polyester, polyurethane, polystyrene, styrene-butadine, epoxy resin, isobutylene rubber, or mixtures thereof.

21. The primer composition of claim 19, further comprising at least one of pentaerythritol tetranitrate, cyclotrimethylenetrinitramine, cyclotetramethylene tetranitramine, trinitrotoluene, and hexanitrohexaazaisowurtzitane.

* * * * *